US009795200B2

(12) United States Patent
Annunziata

(10) Patent No.: US 9,795,200 B2
(45) Date of Patent: Oct. 24, 2017

(54) SOLAR POWERED CORDLESS HAIR DRYER

(71) Applicant: Annmarie Annunziata, Middle Island, NY (US)

(72) Inventor: Annmarie Annunziata, Middle Island, NY (US)

( * ) Notice: Subject to any disclaimer, the term of this patent is extended or adjusted under 35 U.S.C. 154(b) by 0 days.

(21) Appl. No.: 15/193,642

(22) Filed: Jun. 27, 2016

(65) Prior Publication Data

US 2017/0000234 A1 Jan. 5, 2017

Related U.S. Application Data

(60) Provisional application No. 62/186,445, filed on Jun. 30, 2015.

(51) Int. Cl.
*A45D 20/12* (2006.01)

(52) U.S. Cl.
CPC ..... *A45D 20/12* (2013.01); *A45D 2020/128* (2013.01)

(58) Field of Classification Search
CPC ..... A45D 20/12; A45D 2020/128
USPC ..... 34/96–100
See application file for complete search history.

(56) References Cited

U.S. PATENT DOCUMENTS 3,797,475 A 3/1974 Hughes
4,122,396 A * 10/1978 Grazier ..... H01L 31/02021 136/246
4,135,080 A * 1/1979 Wells, Jr. ..... A45D 20/08 34/201
5,195,253 A 3/1993 Poumey et al.
5,787,601 A 8/1998 Stelly
5,873,178 A * 2/1999 Johnson ..... F26B 9/003 34/90
7,748,137 B2 * 7/2010 Wang ..... A01G 9/22 144/364
8,146,264 B1 4/2012 Stefano et al.
8,434,238 B2 * 5/2013 Gross ..... A45D 20/12 132/212
2002/0157276 A1 10/2002 Mujica
2009/0000143 A1 * 1/2009 Bazzicalupo ..... A45D 20/12 34/97

(Continued)

FOREIGN PATENT DOCUMENTS

CN 202077770 U * 12/2011
DE 102008033382 A1 * 12/2009 ..... B41F 15/12

(Continued)

*Primary Examiner* — Stephen M Gravini
(74) *Attorney, Agent, or Firm* — Global Intellectual Property Agency, LLC; Jordan Sworen

(57) ABSTRACT

A solar powered cordless hair dryer. The solar powered cordless hair dryer includes a body having a barrel at one end and a handle extending downward from an opposing end. The barrel includes an air intake end and an air outlet end. A heating element and blower motor are disposed within the housing and are operable via a control disposed on an exterior surface of the housing. LED lights are disposed on the exterior surface of the housing facing the direction of the air outlet end of the barrel. A rechargeable battery provides power to the heating element, blower motor, and LED lights. A solar panel is disposed on an upper surface of the barrel and is configured to convert sunlight into electrical energy in order to recharge the rechargeable battery.

9 Claims, 3 Drawing Sheets

(56) References Cited

U.S. PATENT DOCUMENTS

| | | | | |
|---|---|---|---|---|
| 2009/0147081 | A1* | 6/2009 | Hanson | A45D 20/12 348/77 |
| 2009/0165303 | A1* | 7/2009 | Burgess | B26B 19/063 30/29.5 |
| 2017/0000234 | A1* | 1/2017 | Annunziata | A45D 20/12 |
| 2017/0054296 | A1* | 2/2017 | Daniel | F03D 9/00 |

FOREIGN PATENT DOCUMENTS

| | | | | |
|---|---|---|---|---|
| JP | 2005319252 | A | * | 11/2005 |
| KR | 20140136097 | A | * | 11/2014 |

* cited by examiner

SOLAR POWERED CORDLESS HAIR DRYER

CROSS REFERENCE TO RELATED APPLICATIONS

This application claims the benefit of U.S. Provisional Application No. 62/186,445 filed on Jun. 30, 2015. The above identified patent application is herein incorporated by reference in its entirety to provide continuity of disclosure.

FIELD OF THE INVENTION

The present invention relates to hair dryers. More specifically, the present invention provides a cordless hair dryer having a solar panel for charging a rechargeable battery, which provides power to each of a blower motor, heating element, and an LED array.

BACKGROUND OF THE INVENTION

Hair dryers are commonly used by both salon professionals and individuals at home to dry and style hair. Typical hair dryers require a wired connection with a wall outlet in order to power the blower motor, heating element, and other electronic components of the hair dryer. However, a wired connection is not without drawbacks. When camping or otherwise outdoors and away from a wall outlet, it is impossible to use such hair dryers. Additionally, such environments may lack proper lighting, and an individual may not be able to see well when attempting to use the hair dryer. In order to address these concerns, the present invention provides a solar powered cordless hair dryer having a light array for illuminating objects and surfaces of interest to the user.

Devices have been disclosed in the prior art that relate to hair dryers. These include devices that have been patented and published in patent application publications. These devices generally relate to cordless hair dryers, such as U.S. Pat. No. 8,146,264, U.S. Pat. No. 5,195,253, U.S. Pat. No. 5,787,601, U.S. Published Patent Application Number 2002/0157276, and U.S. Pat. No. 3,797,475.

These prior art devices have several known drawbacks. For example, these prior art devices require a wall outlet connection to recharge a battery, so that they do not truly function as a cordless hair dryer. Further, none of the prior art devices provide an LED for illumination and a solar panel for powering the hair dryer.

In light of the devices disclosed in the prior art, it is submitted that the present invention substantially diverges in design elements from the prior art and consequently it is clear that there is a need in the art for an improvement to existing animal deterring devices. In this regard the instant invention substantially fulfills these needs.

SUMMARY OF THE INVENTION

In view of the foregoing disadvantages inherent in the known types of cordless hair dryers now present in the prior art, the present invention provides a solar powered cordless hair dryer wherein the same can be utilized for providing convenience for the user when drying hair in a location removed from a wall outlet.

The present invention provides a solar powered cordless hair dryer for drying hair away from a wall outlet. The solar powered cordless hair dryer comprises a housing having a barrel thereon, the barrel having an air intake end and an air outlet end. A handle disposed on the housing extends downward from the air intake end of the barrel. A blower motor is disposed within the housing, the blower motor including a fan configured to draw air in from the air intake end of the barrel and expel air from the air outlet end of the barrel. A heating element is further disposed within the housing and is configured to heat air received from the air intake end of the barrel. One or more lights are disposed on an exterior surface of the housing, wherein the one or more lights are disposed such light emanating therefrom is directed toward the air outlet end of the barrel. A rechargeable battery is disposed within the housing and is configured to provide electrical power to each of the blower motor, heating element, and one or more lights. A solar panel is disposed on an upper portion of the housing and is in electrical communication with the rechargeable battery for supplying energy thereto. In this way, the solar powered cordless hair dryer may be utilized and recharged via solar energy, which does not require one to be near a wall outlet.

One object of the present invention is to provide a new cordless hair dryer having all of the advantages of prior art cordless hair dryers and none of the disadvantages.

Another object of the present invention is to provide a solar powered hair dryer having an LED array for illuminating various surfaces, accessories, or other objects during use.

A further object of the present invention is to provide a solar powered hair dryer configured to be powered by a rechargeable battery that is in communication with a solar cell for supplying energy to the same.

Yet another object of the present invention is to provide a solar powered hair dryer having a rechargeable battery that may optionally be recharged via a wall outlet connection.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
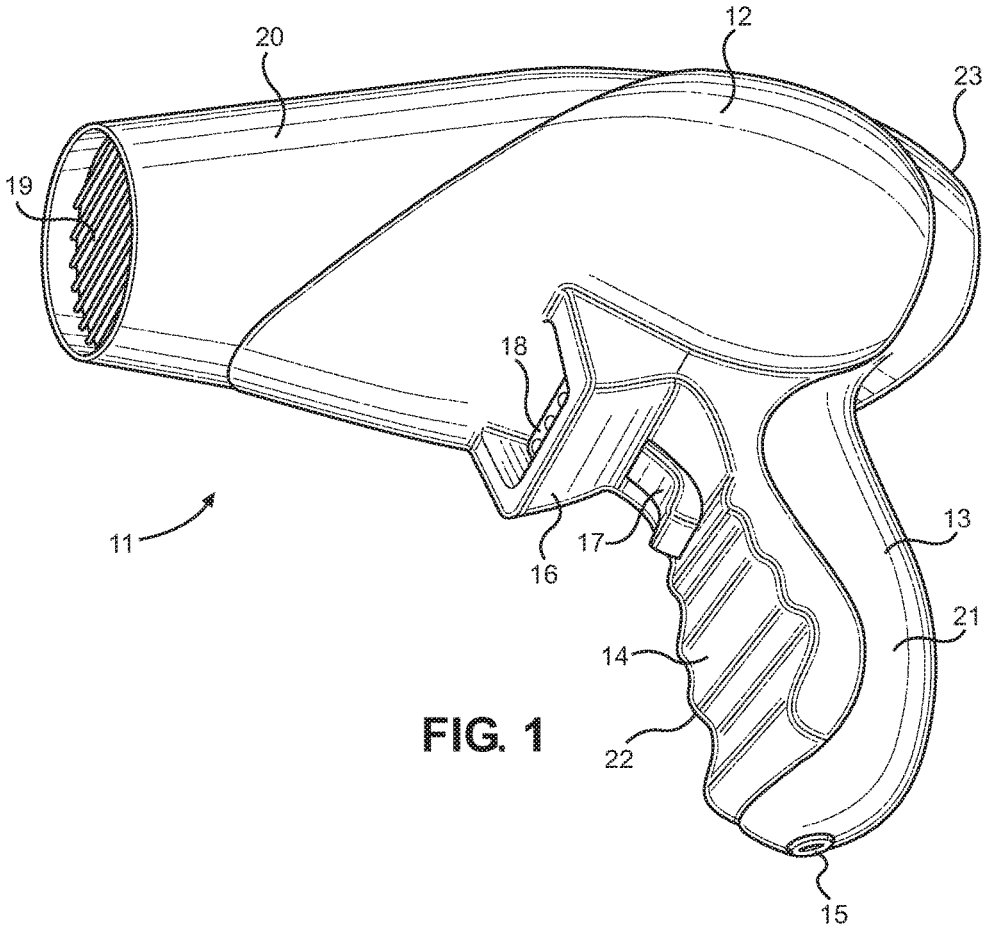
FIG. 1 shows a perspective view of a solar powered cordless hair dryer according to the present invention.

Reference is made herein to the attached drawings. Like reference numerals are used throughout the drawings to depict like or similar elements of the solar powered cordless hair dryer. For the purposes of presenting a brief and clear description of the present invention, the preferred embodiment will be discussed as used for providing a cordless hair dryer that may be recharged using solar energy. The figures are intended for representative purposes only and should not be considered to be limiting in any respect.

Referring now to FIG. 1, there is shown a perspective view of a solar powered cordless hair dryer according to the present invention. The solar powered hair dryer generally comprises a housing 12 having a barrel 20 thereon. The barrel 20 includes an air intake end [add number] and an air outlet end 19. In use, air is drawn in the air intake end and expelled out the air outtake end 19 during use via a blower motor (not shown), providing a stream of air which may be utilized to dry hair. The air may first be heated by passing over a heating element disposed within the housing (not shown).

A handle 13 is further disposed on the housing 12 and extends downward therefrom. The handle 13 provides a contact point for a user to hold the hair dryer 11. In the illustrated embodiment, the handle 13 comprises a smooth outer side [add number] and grip 14 on an inner side thereof. The grip 14 comprises contoured ridges that are ergonomically designed for user comfort when gripping the same.

An LED array 18 is disposed on the housing 12, preferably in a position between the handle 12 and the barrel 20. The LED array 18 may include one or more LED's of any color; however, white LED's are preferred. The LED array 18 is further positioned such that the individual LED's are directed toward the air outlet end 19 of the barrel 20. In this way, a user simply aims the barrel 20 toward an object or surface to be illuminated by the LED array 18. In the illustrated embodiment, the LED array 18 is partially obscured by a shroud 16, which forms a recessed portion in which the LED array 18 is disposed. The shroud 16 assists in directing light from the LED array 18 toward the air outlet end 19 of the barrel 20 by preventing light from escaping in a downward direction toward the handle 13.

A control 17, illustrated here as a trigger disposed on an upper portion of the handle 13, is configured to control the various functions of the hair dryer 11, such as the blower motor, heating element, and LED array. The control receives power from a rechargeable battery disposed within the housing 12. The rechargeable battery may be recharged via a connection 15 to a wall outlet, or may ideally be recharged by a solar panel, which is shown and described in the following paragraphs. In alternate embodiments, the control 17 may further include additional buttons having distinct functions for operating the LED array, heating element, or blower motor. The additional buttons may be disposed on an exterior surface of the housing 12.

Figure 2:
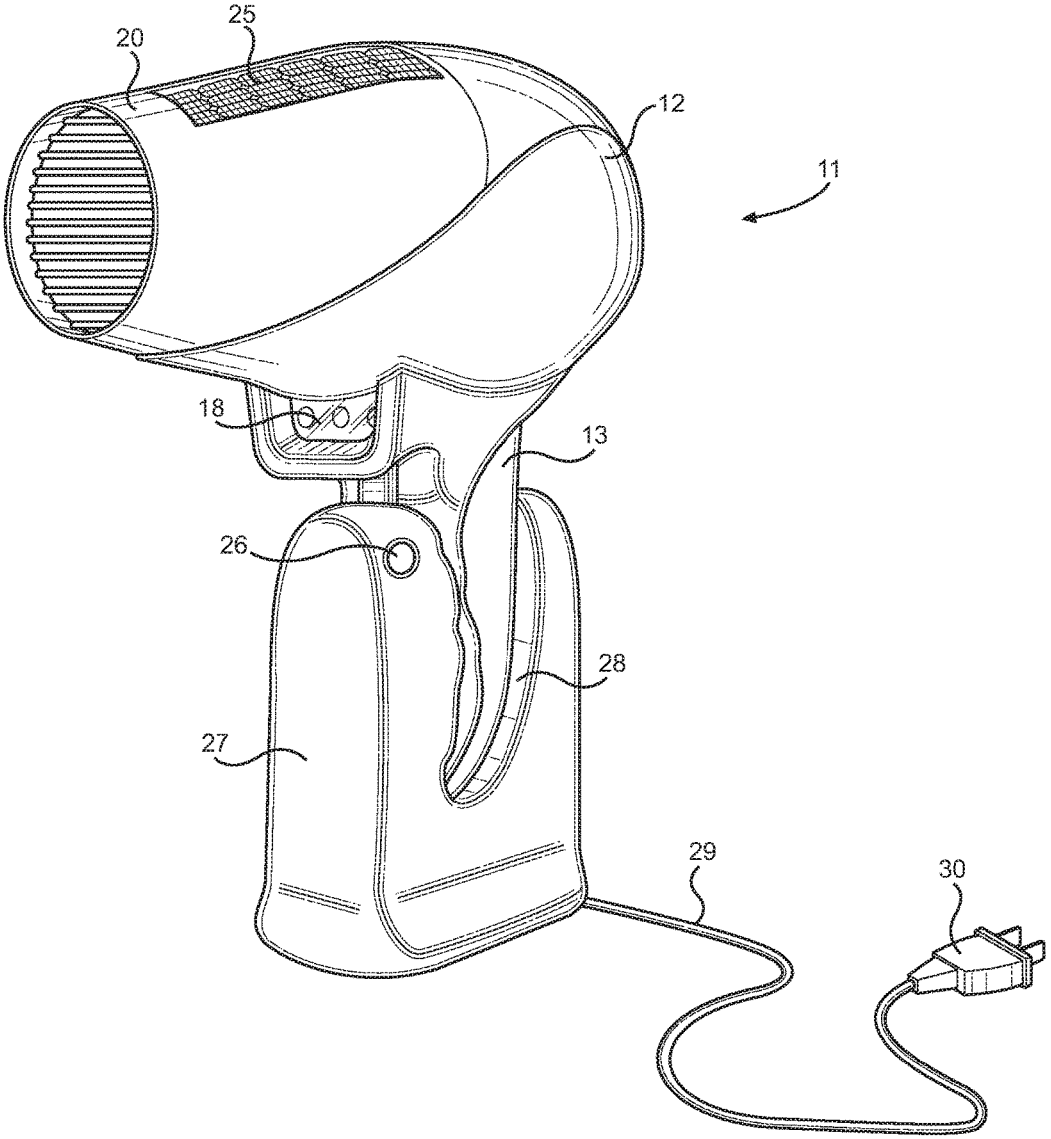
FIG. 2 shows a perspective view of a solar powered cordless hair dryer and wall charger according to the present invention.

Referring now to FIG. 2, there is shown a perspective view of a solar powered cordless hair dryer and charger according to the present invention. The cordless hair dryer 11 further comprises a solar panel 25 thereon. In the illustrated embodiment, the solar panel 25 is disposed on an upper end of the barrel. The solar panel 25 is configured to convert light to electrical energy in order to power the LED array 18 and other electronic components of the cordless hair dryer 11.

The cordless hair dryer 11 further comprises a connection to a wall outlet for recharging the battery when the solar panel 25 is unable to be utilized due to low light conditions. In the illustrated embodiment, a charging dock 27 has a recessed portion 28 that is configured to receive the handle 13 of the cordless hair dryer 11. A cord 29 extends from the charging dock 27 and terminates in a plug 30 that is insertable to a wall outlet. The charging dock 27 comprises an indicator light 26 thereon that is configured to illuminate to notify the user when the battery is recharged. In alternate embodiments, the cordless hair dryer 11 includes a direct connection with a wall outlet that forgoes the use of a charging dock.

In an alternate embodiment, the charging dock 27 further comprises a solar panel thereon. The wall charger solar panel provides an alternate way to charge the rechargeable battery if the user is not in the vicinity of an electrical outlet. In this way, multiple means of recharging the battery are provided, so that the cordless hair dryer 11 may be operable at all times. As such, in different embodiments of the present invention the rechargeable battery may be recharged via a solar panel mounted on either the cordless hair dryer 11 or the charging dock 27, or via a wall outlet connection through the charging dock 27.

Figure 3:
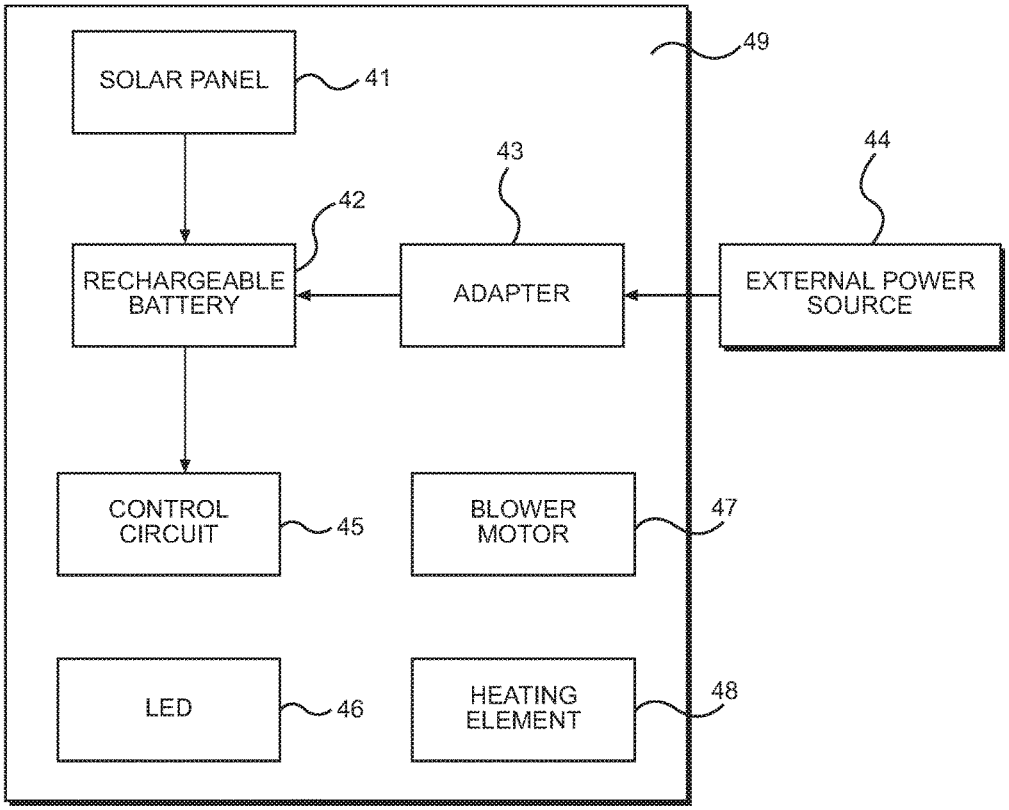
FIG. 3 shows a diagram of the electronic components of a solar powered cordless hair dryer according to the present invention.

Referring now to FIG. 3, there is shown a diagram of the electronic components of a solar powered cordless hair dryer according to the present invention. The electronic components of the cordless hair dryer generally includes a control circuit 45 operable via the control discussed previously, a blower motor 47, a heating element 48, and the LED array 46. A rechargeable battery 42 is in electronic communication with the electronic components for providing electrical power thereto. A solar panel 41 is in electronic communication with the rechargeable battery 42 and is configured to convert sunlight into electrical energy for recharging the same. Alternatively, an adapter 43 is provided that connects an external power source 44 such as a wall outlet or generator to the rechargeable battery 42 in order to provide an additional means for recharging the rechargeable battery 42.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair dryer comprising:

a housing comprising a barrel having an air intake end and an air outlet end;

a handle extending downward from the air intake end of the barrel;

a blower motor disposed within the housing, the blower motor comprising a fan configured to draw air in from the air intake end of the barrel and expel air from the air outlet end of the barrel;

a heating element configured to heat air received from the air intake end of the barrel;

one or more lights disposed on an exterior surface of the housing;

a rechargeable battery configured to provide electrical power to each of the blower motor, heating element, and one or more lights; and a solar panel disposed on an upper portion thereof, wherein the solar panel is configured to convert sunlight into electrical energy in order to charge the rechargeable battery.

2. The hair dryer of claim 1, wherein in the one or more lights comprises an LED array.

3. The hair dryer of claim 1, wherein the one or more lights are disposed within a recessed portion of a shroud disposed on the housing, and wherein the shroud partially obscures the one or more lights.

4. The hair dryer of claim 1, wherein the handle comprises a smooth outer side and a contoured inner side, the contoured inner side comprising a plurality of ridges disposed thereon.

5. The hair dryer of claim 1, further comprising a battery charger configured to recharge the rechargeable battery, the battery charger comprising a recessed portion configured to removably engage the handle, the battery charger being connectable to a wall outlet via a cord.

6. The hair dryer of claim 1, wherein the one or more lights are disposed such that light emanating therefrom is directed toward the air outlet end of the barrel.

7. The hair dryer of claim 1, wherein the solar panel is disposed on the barrel.

8. The hair dryer of claim 1, further comprising one or more controls thereon, wherein the one or more controls are configured to operate each of the blower motor, heating element, and one or more lights.

9. The hair dryer of claim 1, wherein the control is a trigger disposed on an upper portion of the handle.

* * * * *